US006454667B1

(12) United States Patent
Iwami

(10) Patent No.: US 6,454,667 B1
(45) Date of Patent: Sep. 24, 2002

(54) GOLF BALL WITH SUPERIOR DURABILITY

(75) Inventor: Satoshi Iwami, Akashi (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/543,587

(22) Filed: Apr. 5, 2000

(30) Foreign Application Priority Data

Apr. 9, 1999 (JP) ..... 11-102336

(51) Int. Cl.[7] ..... A63B 37/12; A63B 37/00
(52) U.S. Cl. ..... 473/378; 473/351
(58) Field of Search ..... 473/356, 351, 473/362, 363, 365, 371, 377, 378, 600, 607

(56) References Cited

U.S. PATENT DOCUMENTS 5,695,414 A 12/1997 Yokota
5,776,013 A * 7/1998 Yokota et al. ..... 473/377
5,816,943 A 10/1998 Masutani et al.

FOREIGN PATENT DOCUMENTS

JP 8322961 12/1996

OTHER PUBLICATIONS

Wicks, Zeno W., "Coatings", Encyclopedia of Polymer Science and Technology, Copyrigh 2002 John Wiley & Sons, Inc.*

* cited by examiner

*Primary Examiner*—Steven Wong
*Assistant Examiner*—Alvin A. Hunter
(74) *Attorney, Agent, or Firm*—Birch, Stewart, Kolasch & Birch, LLP

(57) ABSTRACT

A cover of a golf ball is prepared to have Shore D hardness in a range of 50 to 65 and flexural modulus in a range of 98 to 196 MPa and 10% modulus of paint applied onto the cover surface is accordingly adjusted in a range of 0.49 to 4.9 MPa. The golf ball thus produced maintains flight characteristics and shot feel for a round of golf while having improved resistance to wear and burr.

11 Claims, No Drawings

GOLF BALL WITH SUPERIOR DURABILITY

BACKGROUND OF THE INVENTION

1. Field of the Invention

The present invention relates to golf balls, particularly those for practice which are superior in durability and highly resistant to burr and cutting due to the grooves on the club face of an iron.

2. Description of the Background Art

Conventional golf balls used in the practice field (practice balls) have mainly been one-piece balls because durability is considered highly important. However, the one-piece balls are significantly inferior to the balls used for a round of golf (round balls as distinguished from practice balls) in the flight performance and shot feel.

Golfers would prefer to use the round balls having excellent shot feel and flight performance. Although the round balls, specifically thread-wound balls formed by winding a rubber thread around a center and molding the exterior of the rubber thread layer with a cover have remarkably superior shot feel, they are extremely inferior in durability and are expensive, and accordingly are inappropriate as practice balls.

Two-piece balls for a round of golf which are formed by a core with a relatively rigid ionomer cover are superior to the thread-wound balls in the durability. However, if the two-piece ball is struck particularly by an iron club to attain loft, the surface of the cover wears due to the grooves of the club face and accordingly dimples become shallower, resulting in a shorter carry. Paint having white pigment blended therein is usually applied onto the surface of the cover of the golf ball. The white paint could undesirably attach to and thus foul the club face when the club hits the ball.

According to a proposal in Japanese Patent Laying-Open No. 8-322961, the average thickness of a coating layer or the pencil hardness of a coating film is set in a specific range so as to optimize initial conditions of shot (shot angle, spin rate) and to enhance protection of a mark and the like provided on the surface of a golf ball. However, this prior art does not discuss the effect of the resistance to burr and wearing.

Round balls are superior in the flight characteristics and shot feel while they are inferior in: 1) the resistance to wear (durability); and 2) the resistance to burrs of the cover surface, as may be caused by dirt on the club face. Therefore, the round balls are not proper for use as practice balls.

SUMMARY OF THE INVENTION

One object of the present invention is to provide a golf ball which is highly resistant to wear as well as burr and cutting due to grooves of the club face of an iron while maintaining characteristics of the flight performance and shot feel as a round ball.

In order to achieve the above object, a golf ball according to the present invention has a cover with which a core is molded, the cover is prepared to have Shore D hardness of 50 to 65 and flexural modulus of 98 MPa to 196 MPa, and paint applied onto the surface of the cover has 100% modulus of 0.49 to 4.9 MPa so as to improve the resistance to burr and wear.

Conventional golf balls are designed such that there is a great difference between cover material and paint in their values of hardness and flexural modulus. In this case, deformation of a struck golf ball causes strain on the boundary between the cover and paint, leading to fatigue and damage to the paint. The present invention accordingly allows the cover to have a lower hardness than that of a conventional cover so as to enhance the shot feel, and uses a relatively flexible material as the paint applied onto the cover according to the characteristics of the cover. Consequently, the cover and paint take the same deformation behavior when the golf ball is hit, so that coating fatigue can be reduced remarkably.

The foregoing and other objects, features, aspects and advantages of the present invention will become more apparent from the following detailed description of the present invention when taken in conjunction with the accompanying drawings.

DETAILED DESCRIPTION OF THE INVENTION

According to the present invention, a cover is prepared to have Shore D hardness in a range of 50 to 65 which is lower than that of a cover of a normal ball for golf range. If the Shore D hardness is smaller than 50, the resilience of ball decreases and thus the carry becomes shorter. On the other hand, if the Shore D hardness exceeds 60, the resistance to wear and burr of the ball deteriorates.

It is noted that the Shore D hardness is measured according to ASTM D-2240 by using a thermal press molded sheet with a thickness of about 2 mm which is formed of each cover composition and preserved at 23° C. for two weeks.

Further, the cover is prepared to have flexural modulus in a range of 98 to 196 MPa. If the flexural modulus is smaller than 98 MPa, the impact resistance as well as the hardness decrease, resulting in a shorter carry. If the flexural modulus is greater than 196 MPa, the duralibility as well as the resistance to burr deteriorate.

It is noted that the flexural modulus is measured according to JISK 7106 using a thermal press molded sheet with a thickness of about 2 mm which is formed of each cover composition and preserved at 23° C. for two weeks.

Ionomer resin is used as a base material of the cover, and the cover is prepared by blending one or at least two types of the ionomer resin such that the Shore D hardness is in a range of 50 to 65 and the flexural modulus is in a range of 98 to 196 MPa. In addition to the ionomer resin, titanium oxide ($TiO_2$), photo-stabilizer, colorant, antioxidant and the like are blended as required the ionomer resin may partially be substituted with other polymers such as polyethylene and polyamide without deteriorating the characteristics (e.g. high resistance to cutting) of the ionomer resin.

As the ionomer resin, Hi-milan #1065, Hi-milan #1705, Hi-milan #1706 and the like manufactured by Mitsui-DuPont Polychemical Co., Ltd. may be used. However, if any of them is solely employed, the ranges of the Shore D hardness of 50 to 65 and of the flexural modulus of 98 to 196 Mpa are difficult to achieve in most cases. Therefore, preferably an monomer resin having a small flexural modulus such as Hi-milan #1855 (flexural modulus: 87 MPa) manufactured by Mitsui-DuPont Polychemical Co., Ltd. is additionally employed so as to adjust the flexural modulus within the above range.

In the present invention, commercially available materials having the trade names of ESCOR and IOTEK produced by Exxon Chemical Japan Ltd., for example, may be used as the ionomer resin. Regarding the blend of the ionomer resin, ionomer resin materials neutralized by sodium ion and zinc ion respectively may be blended. More preferably, ionomer resin materials all neutralized by zinc ion may be blended.

The present invention is applicable to a single layer cover as well as a multi-layer cover. In the case of the multi-layer cover, the Shore D hardness and the flexural modulus of the outermost layer of the cover contacting the paint should be in the ranges of the Shore D hardness and flexural modulus respectively mentioned above.

Paint applied onto the cover in the present invention is prepared to have 10% modulus in a range of 0.49 to 4.9 MPa, preferably in a range of 1.47 to 3.9 MPa in particular.

The paint may consist of either a single layer or a multi-layer. If the paint has a multi-layer, the outermost layer should have 10% modulus in a range of 0.49 to 4.9 MPa. Excessively thick paint is not preferable, and accordingly the thickness of the paint is set in a range of 10 to 40 $\mu$m so as to allow the paint to follow the deformed cover when it is struck. In particular, if the paint is formed of a plurality of layers, the thickness of at least the outermost layer is set in a range of 5 to 20 $\mu$m.

Although there is no restriction as to the types of paint materials used in the present invention, thermoplastic resin-based paint or thermoset resin-based paint is appropriate for the paint material. Employable materials are urethane resin-based paint, epoxy resin-based paint, acrylic resin-based paint, vinylacetate resin-based paint, and polyester resin-based paint, for example. In particular, the urethane resin-based paint is prepared by reacting polyester polyol as a base material resin with isocyanate. In this case, a predetermined value of the 10% modulus can be achieved mainly by changing the molecular weight and hydroxy group content of the base material resin.

If paint with white pigment blended therein is used to apply it onto the cover surface of a general golf ball for practice, the white paint attaches to and thus fouls the club face upon iron shot. The present invention employs a clear paint containing no white pigment as the paint, applies one layer or a plurality of layers of the clear paint, and sets 10% modulus of the applied paint in a range of 0.49 to 4.9 MPa. In this way, enhancement is possible of the resistance to burr and the resistance to cutting due to grooves of the club face upon iron shot. If the 10% modulus is out of the above range, the ball is susceptible to burr and progressive wearing.

The 10% modulus of the paint is measured here by forming a sheet of 0.25 mm in thickness by applying paint flatly and curing it, punching out a sample of 0.25 mm thick with a dumbbell 45 type, and measuring the modulus of the sample at a tensile rate of 50 mm/min.

In the present invention, the inner core is not particularly limited to the one having thread-wound structure, a solid core, and the like. However, in terms of durability, a core for a solid ball such as two-piece ball and three-piece ball is preferable. The core is constituted of a crosslinked product of a rubber composition. For a rubber component of the rubber composition, butadiene rubber having a high cis-1,4-structure is appropriate as a base material. It is noted that in addition to the butadiene rubber, natural rubber, styrene butadiene rubber, isoprene rubber, chloroprene rubber, butyl rubber, ethylene-propylene rubber, ethylene-propylene diene rubber, and/or acrylonitrile rubber, for example, may be blended at a ratio of at most 40 parts by weight per 100 parts by weight of rubber component.

An example of a crosslinking agent used for the rubber composition is metal salt of $\alpha$, $\beta$-ethylenic unsaturated carboxylic acid produced by reacting $\alpha$, $\beta$-ethylenic unsaturated carboxylic acid such as acrylic acid and methacrylic acid with metallic oxide such as zinc oxide during preparation of the rubber composition. Other examples are metal salt of $\alpha$, $\beta$-ethylenic unsaturated carboxylic acid such as zinc acrylate and zinc methacrylate, polyfunctional monomer, N, N' phenyl bis maleimide, sulfur, and the like that are usually employed as the crosslinking agent. In particular, metal salt of $\alpha$, $\beta$-ethylenic unsaturated carboxylic acid, specifically zinc salt is preferred. For example, if metal salt of $\alpha$, $\beta$-ethylenic unsaturated carboxylic acid is used, it is preferably blended at a ratio of 20 to 40 parts by weight per 100 parts by weight of rubber component. If $\alpha$, $\beta$-ethylenic unsaturated carboxylic acid is reacted with metallic oxide during preparation of the rubber composition, 15 to 30 parts by weight of $\alpha$, $\beta$-ethylenic unsaturated carboxylic acid and 15 to 35 parts by weight of metallic oxide such as zinc oxide per 100 parts by weight of the $\alpha$, $\beta$-ethylenic unsaturated carboxylic acid are preferably blended.

As a filler used for the rubber composition, inorganic powder of one or more of barium sulfate, calcium carbonate, clay, zinc oxide and the like, for example, may be used. The amount of blended filler is preferably in a range of 5 to 50 parts by weight per 100 parts by weight of the rubber component.

In addition, a softening agent, liquid rubber or the like may be blended appropriately in order to improve operation easiness and adjust hardness. Further, an antioxidant may appropriately be blended for preventing aging.

As a crosslinking initiator, organic peroxide such as dicumyl peroxide and 1,1-bis (t-butyl peroxide) 3,3,5-trimethyl cyclohexane is used, for example. The amount of blended crosslinking initiator is preferably in a range of 0.1 to 5, particularly 0.3 to 3 parts by weight per 100 parts by weight of the rubber component.

The core is produced by mixing those blend materials with a roll, kneader, Banbury and the like, and vulcanizing the mixed materials at 145° C. to 200° C., preferably 150° C. to 175° C. under pressure for 10 to 40 minutes using a mold. In order to improve adhesion between the core and the cover, an adhesive may be applied to the surface of the resultant core or the surface may be made rough.

EXAMPLES

Examples are used for specifically describing the present invention. It is noted that the present invention is not limited to these examples. Golf balls were produced in respective examples 1 to 8 and examples for comparison 1 to 8 through the processes shown in the sections 1 to 3 below.

1. Preparation of Core

A solid core having an average diameter of 39.0 mm was produced by blending 34 parts by weight of zinc acrylate, 5 parts by weight of zinc oxide, 10 parts by weight of tungsten, 0.15 parts by weight of sulfur compound, 1.5 parts by weight of dicumyl peroxide, and 0.5 parts by weight of antioxidant (Yoshinox 425 (trade name) by Yoshitomi Pharmaceutical Industries Ltd.) per 100 parts by weight of polybutadiene (BR-18 (trade name) by JSR Corporation), and heating the resultant rubber composition at 160° C. for 15 minutes so as to mold the core through vulcanization.

2. Preparation of Composition for Cover

Blend constituent materials shown in Table 1 and Table 2 were mixed by a two-shaft kneading type extruder so as to prepare a pellet-shaped composition for a cover. The amounts of blended components shown in the table are represented by parts by weight, and the components denoted by the trade names are illustrated in detail in Table 2. The extruding conditions were the screw diameter of 45 mm, the number of revolutions of the screw of 200 rpm and the screw L/D of 35, and the blended product was heated to 220 to 260° C. at the position of the die of the extruder.

The flexural modulus and Shore D hardness of the resultant cover composition were measured. The measurements are shown in Table 1 together with the components of the cover composition. The method of measuring the flexural modulus and Shore D hardness is the above-described one.

TABLE 1

| Composition | No. 1 | 2 | 3 | 4 | 5 |
|---|---|---|---|---|---|
| Component | | | | | |
| Hi-milan #1555 | | | 30 | | |
| Hi-milan #1557 | 30 | 30 | | | |
| Hi-miian #1605 | | | | 50 | |
| Hi-milan #1706 | | | | 50 | |
| Hi-milan #1707 | 20 | 20 | | | |
| Hi-milan #1855 | 50 | | | | 100 |
| Surlyn AD8542 | | 50 | 70 | | |
| Titanium Oxide | 2 | 2 | 2 | 2 | 2 |
| Barium Sulfate | 2 | 2 | 2 | 2 | 2 |
| Physical Properties | | | | | |
| Shore D Hardness | 63 | 57 | 51 | 70 | 54 |
| Flexural Modulus MPa ($kgf/cm^2$) | 157 (1600) | 137 (1400) | 103 (1050) | 314 (3200) | 90 (920) |

consisting of polyisocyanate were blended at an equivalent ratio (NCO/OH) 1.2 of the isocyanate group of the curing agent to the hydroxy group of the main material.

The equivalent of the hydroxy group is determined by the following formula.

$$\text{Equivalent of Hydroxy Group (mgKOH/g)}=56.1\times(B-A)\times f/S$$

where

A: the amount of 1N sodium hydroxide solution required for titration of sample (ml), B: the amount of 1N sodium hydroxide solution required for titration of blank (ml), f: factor of 1N sodium hydroxide solution and S: weight of sample (g).

(2) Composition 2 (10% modulus: 0.98 MPa (10 $Kgf/cm^2$))

Polyester polyol with weight-average molecular weight (Mw) of 4000 was used. Other components and conditions were the same as those for composition 1 above.

(3) Composition 3 (10% modulus: 1.98 MPa (20 $Kgf/cm^2$))

Polyester polyol with weight-average molecular weight (Mw) of 6000 was used. Other components and conditions were the same as those for composition 1 above.

(4) Composition 4 (10% modulus: 2.94 MPa (30 $Kgf/cm^2$))

TABLE 2

| Trade Name | Metal Type | Acid Content | Degree of Neutralization | Hardness (D) | Flexural Modulus MPa ($kg/cm^2$) | Component | Manufacturer |
|---|---|---|---|---|---|---|---|
| Hi-milan #1555 | Na | 11 | 37 | 57 | 250 (2,550) | Ethylene/methacrylic acid binary copolymerization ionomer neutralized by Na | Mitsui-DuPont Polychemical Co., Ltd |
| Hi-milan #1557 | Zn | 11 | 57 | 57 | 250 (2,550) | Ethylene/methacrylic acid binary copolymerization ionomer neutralized by Zn | Mitsui-Dupont Polychemical Co., Ltd |
| Hi-milan #1605 | Na | 15 | 29 | 61 | 370 (3,770) | Ethylene/methacrylic acid binary copolymerization ionomer neutralized by Na | Mitsui-DuPont Polychemical Co., Ltd. |
| Hi-milan #1706 | Zn | 15 | 58 | 60 | 329 (3,360) | Ethylene/methacrylic acid binary copolymerization ionomer neutralized by Zn | Mitsui-Dupont Polychemical Co., Ltd. |
| Hi-milan #1707 | Zn | 15 | 59 | 62 | 379 (3,870) | Ethylene/methacrylic acid binary copolymerization ionomer neutralized by Na | Mitsui-Dupont Polychemical Co., Ltd. |
| Hi-milan #1855 | Zn | 10 | 73 | 54 | 90 (917) | Ethylene/methacrylic acid/i-butyl acrylate ternary copolymerization ionomer neutralized by Zn | Mitsui-DuPont Polychemical Co., Ltd. |
| Surlyn AD8542 | Mg | 10 | 50 | 44 | 35 (357) | Ethylene/methacrylic acid/n-butyl acrylate ternary copolymerization ionomer neutralized by Mg | Mitsui-DuPont Polychemical Co., Ltd. |

3. Production of Golf Ball

The composition for cover prepared in the process 2 above was injection molded directly on the solid core prepared in the process 1 so as to cover the solid core. Paints of composition 1 to composition 7 were applied to the resultant balls to produce golf balls each having outer diameter of 42.7 mm and weight of 45.4 g.

The resistance to wear and the resistance to burr of the produced golf balls were measured by the method illustrated later. Measurements thus obtained are shown in Table 3 and Table 4.

(1) Composition 1 (10% modulus: 1.47 MPa (15 $Kgf/cm^2$))

A main material consisting of polyester polyol with weight-average molecular weight (Mw) of 5000 and equivalent of hydroxy group of 120 mgKOH/g and a curing agent A main material consisting of acrylic polyol having weight-average molecular weight (Mw) of 27,000 and equivalent of hydroxy group of 130 mgKOH/g and polyester polyol having weight-average molecular weight (Mw) of 3000 and equivalent of hydroxy group of 130 mgKOH/g and a curing agent consisting of polyisocyanate were blended at an equivalent ratio (NCO/OH) 1.0 of the isocyanate group of the curing agent to the hydroxy group of the main material.

(5) Composition 5 (10% modulus: 3.92 MPa (40 $Kgf/cm^2$))

Acrylic polyol with weight-average molecular weight (Mw) of 3000 and polyester polyol with weight-average molecular weight (Mw) of 4000 were used. Other components and conditions were the same as those for composition 4 above.

(6) Composition 6 (10% modulus: 7.35 MPa (75 $Kgf/cm^2$))

A main material consisting of polyester polyol with weight-average molecular weight (Mw) of 8000 and equivalent of hydroxy group of 70 mgKOH/g and a curing agent consisting of polyisocyanate were blended at an equivalent ratio (NCO/OH) 0.7 of the isocyanate group of the curing agent to the hydroxy group of the main material.

(7) Composition 7 (10% modulus: 47.0 MPa (480 Kgf/$cm^2$))

A main material consisting of polyester polyol with weight-average molecular weight (Mw) of 4500 and equivalent of hydioxy group of 60 mgKOH/g and polyester polyol with weight-average molecular weight (Mw) of 5000 and equivalent of hydroxy group of 55 mgKOH/g and a curing agent consisting of polyisocyanate were blended at an equivalent ratio (NCO/OH) 1.2 of the isocyanate group of the curing agent to the hydroxy group of the main material.

Resistance to Wear

Hone stones, a ball and water were placed in a ball mill and they were stirred for 8 hours. The ball was then cleaned to measure the volume of a dimple.

The value of ratio of "dimple volume after stirring/dimple volume before stirring×100 (%)" was determined for examining to which degree the dimples were left. The greater the determined value of ratio of the dimple volume, the more excellent the resistance to wear.

Resistance to Burr

A ball was kept warm at 23° C., an approach wedge was attached to a robot machine, two spots of the ball were struck at the head speed of 32 m/s once for each spot, the two struck spots were observed, and then evaluation was done based on the evaluation standards listed below.

Point 5: No change is observed on the ball surface.

Point 4: Although there is found a faint trace of the club face, it is indistinctive.

Point 3: Although there is a relatively distinctive trace of the club face, the cover surface is not napped.

Point 2: The surface is burred and conspicuously napped.

Point 1: The surface is burred and a slight crack is observed.

According to Table 3, the great total volume of dimples as well as high resistance to burl were maintained in the examples of the present invention upon the wear resistance test.

TABLE 3

| | | Example | | | | | | | |
|---|---|---|---|---|---|---|---|---|---|
| | | 1 | 2 | 3 | 4 | 5 | 6 | 7 | 8 |
| Cover Composition | | 1 | 1 | 1 | 1 | 2 | 3 | 1 | 1 |
| Paint | Inner Layer | | | | | | | | |
| | 10% modulus MPa | 0.98 | 1.47 | 1.98 | 3.92 | 1.47 | 1.47 | | 7.35 |
| | (kgf/$cm^2$) | (10) | (15) | (20) | (40) | (15) | (15) | | (75) |
| | Coating Thickness (μm) | 15 | 15 | 15 | 15 | 15 | 15 | | 80 |
| | Composition No. | 2 | 1 | 3 | 5 | 1 | 1 | | 6 |
| | Outer Layer | | | | | | | | |
| | 10% modulus MPa | 1.47 | 1.47 | 2.94 | 3.92 | 1.47 | 1.47 | 1.47 | 1.47 |
| | (kgf/$cm^2$) | (15) | (15) | (30) | (40) | (15) | (15) | (15) | (15) |
| | Coating Thickness (μm) | 15 | 15 | 15 | 15 | 15 | 15 | 20 | 15 |
| | Composition No. | 1 | 1 | 4 | 5 | 1 | 1 | 1 | 1 |
| | Total Coating Thickness (μm) | 30 | 30 | 30 | 30 | 30 | 30 | 20 | 30 |
| Physical Properties | Resistance to Wear | 80 | 80 | 80 | 80 | 80 | 80 | 85 | 70 |
| | Total Dimple Volume ($mm^3$) | | | | | | | | |
| | Resistance to Burr | 5 | 4 | 4 | 3 | 3 | 3 | 4 | 3 |

TABLE 4

| | | Comparative Example | | | | | | | |
|---|---|---|---|---|---|---|---|---|---|
| | | 1 | 2 | 3 | 4 | 5 | 6 | 7 | 8 |
| Cover Composition | | 1 | 1 | 1 | 4 | 4 | 4 | 4 | 5 |
| Paint | Inner Layer | | | | | | | | |
| | 10% modulus MPa | 7.35 | 1.47 | | | 7.35 | 47.0 | 2.94 | |
| | (kgf/$cm^2$) | (75) | (15) | | | (75) | (480) | (30) | |
| | Coating Thickness (μm) | 15 | 15 | | | 15 | 25 | 45 | |
| | Composition No. | 6 | 1 | | | 6 | 7 | 4 | |
| | Outer Layer | | | | | | | | |
| | 10% modulus MPa | 7.35 | 7.35 | 7.35 | 1.47 | 7.35 | 7.35 | 1.47 | 1.47 |
| | (kgf/$cm^2$) | (75) | (75) | (75) | (15) | (75) | (75) | (15) | (15) |
| | Coating Thickness (μm) | 15 | 15 | 20 | 20 | 15 | 25 | 45 | 20 |
| | Composition No. | 6 | 6 | 6 | 1 | 6 | 6 | 1 | 1 |
| | Total Coating Thickness (μm) | 30 | 30 | 20 | 20 | 30 | 50 | 90 | 20 |
| Physical Properties | Resistance to Wear | 65 | 70 | 70 | 70 | 60 | 55 | 65 | 70 |
| | Total Dimple Volume ($mm^3$) | | | | | | | | |
| | Resistance to Burr | 1 | 2 | 1 | 1 | 1 | 1 | 2 | 2 |

Referring to Table 4, in comparative example 1, 10% modulus of the paint is too high so that the resistance to wear and resistance to burr are remarkably deteriorated. In comparative example 2, 10% modulus of the inner layer of the paint is set small and accordingly the resistance to wear and resistance to burr are slightly improved. However, those characteristics are almost equivalent to those in example 8 in which the outer layer of the paint has a small 10% modulus. In comparative examples 4 to 7, cover materials having high Shore D hardness and high flexural modulus are used. Comparative example 8 uses the cover material having low Shore D hardness and low flexural modulus.

According to the present invention, a cover of a golf ball is formed of a relatively soft material having Shore D hardness and flexural modulus in specific ranges respectively, and 10% modulus of paint applied onto the surface of the cover is adjusted according to the properties of the cover. Consequently, a golf ball providing excellent shot feel and having superior flight properties while having improved resistance to burr and resistance to wear (durability) can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf ball with superior durability comprising a core, a cover, and at least one layer of paint applied onto said cover, said cover having Shore D hardness of 50 to 65 and flexural modulus of 98 to 196 MPa, and at least an outermost layer of said paint having 10% modulus of 0.49 to 4.9 MPa.

2. The golf ball according to claim 1, wherein said paint is clear paint containing no white pigment.

3. The golf ball according to claim 1, wherein said paint has a thickness of 10 to 40 $\mu$m.

4. The golf ball according to claim 1, wherein said outermost layer of said paint has 10% modulus of 1.47 to 3.92 MPa.

5. The golf ball according to claim 1, wherein said cover is prepared by blending at least one type of ionomer resin.

6. A golf ball according to claim 5, wherein said cover further comprises at least one selected from the group consisting of titanium oxide ($TiO_2$), photo-stabilizer, colorant and antioxidant.

7. A golf ball according to claim 5, wherein said ionomer resin is partially substituted with a second polymer.

8. A golf ball according to claim 7, wherein the second polymer is at least one selected from the group consisting of polyethylene and polyamide.

9. A golf ball according to claim 5, wherein said ionomer resin blend is neutralized with at least one selected from the group consisting of sodium ion and zinc ion.

10. A golf ball according to claim 1, wherein the paint has a thickness in a range of 10 to 40 $\mu$m.

11. A golf ball according to claim 1, wherein the paint is at least one selected from the group consisting of urethane resin-based paint, epoxy resin-based paint, acrylic resin-based paint, vinylacetate resin-based paint and polyester resin-based paint.

* * * * *